US011189912B2

(12) United States Patent
Leborgne

(10) Patent No.: US 11,189,912 B2
(45) Date of Patent: Nov. 30, 2021

(54) MODULAR INTERFACE SYSTEM FOR AN ANTENNA REFLECTOR, IN PARTICULAR FOR AN ANTENNA OF A SPACE CRAFT, SUCH AS A SATELLITE, IN PARTICULAR

(71) Applicant: ArianeGroup SAS, Paris (FR)

(72) Inventor: Florian Leborgne, Montigny le Bretonneux (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 16/627,140

(22) PCT Filed: May 31, 2018

(86) PCT No.: PCT/FR2018/000152
§ 371 (c)(1),
(2) Date: Dec. 27, 2019

(87) PCT Pub. No.: WO2019/002702
PCT Pub. Date: Jan. 3, 2019

(65) Prior Publication Data

US 2020/0144705 A1 May 7, 2020

(30) Foreign Application Priority Data

Jun. 30, 2017 (FR) ..... 1756210

(51) Int. Cl.
*H01Q 1/28* (2006.01)
*H01Q 1/12* (2006.01)
*H01Q 15/16* (2006.01)

(52) U.S. Cl.
CPC ..... *H01Q 1/288* (2013.01); *H01Q 1/1221* (2013.01); *H01Q 15/16* (2013.01)

(58) Field of Classification Search
CPC .... H01Q 1/288; H01Q 1/1207; H01Q 1/1221; H01Q 15/16
See application file for complete search history.

(56) References Cited

U.S. PATENT DOCUMENTS 3,898,667 A 8/1975 Raab
4,222,368 A * 9/1980 Rost ..... F24S 25/13 126/600

(Continued)

FOREIGN PATENT DOCUMENTS

EP 2818734 A1 12/2014
WO 2010/112601 A1 10/2010

OTHER PUBLICATIONS

International Search Report for International Application No. PCT/FR2018/000152 dated Aug. 1, 2018.

(Continued)

*Primary Examiner* — Hoang V Nguyen
(74) *Attorney, Agent, or Firm* — Pearne & Gordon LLP

(57) ABSTRACT

The modular interface system comprises an interface part intended to be mechanically connected to a mechanical element forming part of a platform of a space craft, a multi-pronged structure provided, at a first end, with at least three feet and configured to form a mechanical link between, on the one hand, the interface part arranged at a second end opposite the first end and, on the other hand, respectively, a plurality of junction elements, each junction element being connected to one of the feet of the multi-pronged structure with which it is associated, and the junction elements being intended to be mechanically connected to a rear face of the antenna reflector.

14 Claims, 4 Drawing Sheets

(56) References Cited

U.S. PATENT DOCUMENTS

| | | | | |
|---|---|---|---|---|
| 4,550,319 | A * | 10/1985 | Ganssle | H01Q 1/18 343/882 |
| 6,276,649 | B1 | 8/2001 | Kruse | |
| 2014/0191925 | A1 | 7/2014 | Theunissen et al. | |
| 2017/0025745 | A1* | 1/2017 | Clayton | H01Q 1/1228 |

OTHER PUBLICATIONS

Written Opinion for International Application No. PCT/FR2018/000152 dated Aug. 1, 2018.
Preliminary French Search Report for French Patent Application No. 1756210, dated Feb. 27, 2018.

* cited by examiner

MODULAR INTERFACE SYSTEM FOR AN ANTENNA REFLECTOR, IN PARTICULAR FOR AN ANTENNA OF A SPACE CRAFT, SUCH AS A SATELLITE, IN PARTICULAR

The present invention concerns a modular interface system for an antenna reflector, in particular for an antenna of a space craft, in particular of a satellite, together with an antenna reflector comprising one or more such modular interface systems.

STATE OF THE PRIOR ART

Although non-exclusively, the present invention applies more specifically to an antenna reflector of a telecommunications satellite, for example an large-size antenna reflector. Such an antenna reflector generally comprises a rigid structure (called a shell) with a reflecting surface (which is reflecting for radio waves) and strengthening means behind this surface, which help hold the shell in space, and contribute to the connection with the satellite.

More specifically, the vast majority of solid shell antenna reflectors are based on the assembly of the following three elements:

- the shell with the reflecting surface, which produces the functional interface with the radio waves;
- interface elements enabling the reflector to be held on the platform (of the satellite) at launch, but also its deployment in orbit (via a deployment arm and a motor); and
- a rear structure allowing the structural connection between the interface elements of the platform and the shell with the reflecting surface.

Reflectors produced in this manner invariably require many part references, specific one-off designs and multiple assemblies.

A simplification of the antenna reflector is therefore sought, in particular to reduce costs.

The technical solution and the associated technologies to achieve simplification must be able to produce solutions for at least some of the following problems:

- provide modularity of the assemblies to satisfy the various interface requirements of the platform (number of interface points, positions, stiffness specifications, etc.);
- ensure multi-surface compatibility;
- guarantee mechanical, thermal and functional performance with appropriate characteristics; and
- enable simplified industrialisation and exploitation.

DESCRIPTION OF THE INVENTION

The purpose of the present invention is to contribute to the simplification of such an antenna reflector. It concerns a modular interface system intended to produce an interface between an antenna reflector of a space craft, in particular of a satellite, and a platform of the space craft.

According to the invention the said modular interface system comprises:

- an interface part which is intended to be mechanically connected to a mechanical element forming part of the said platform;
- a multi-legged structure having, at a first end, at least three feet, configured to make a mechanical connection between, firstly, the interface part installed at a second end opposite the said first end, and secondly, respectively, a plurality of links, where each link is connected to one of the feet of the multi-legged structure with which it is associated; and
- the said links, which are intended to be mechanically connected to a rear face of the antenna reflector.

By virtue of the invention, the modular interface system, in addition to providing modularity, has many other advantages, as described below.

Advantageously, the modular interface system comprises:

- a screw connection between each of the said links and the associated foot of the multi-legged structure; and/or
- a screw connection between the interface part and the multi-legged structure.

In addition, advantageously:

- the interface part comprises a ball joint which is intended to be mechanically connected to the said mechanical element forming part of the platform, and which can be set securely in position; and/or
- each of the said links comprises a bracket of roughly flat shape, intended to be mechanically connected to the rear face of the antenna reflector, and a rod installed in a transverse direction (preferably roughly orthogonally) to the said bracket.

In addition, preferentially, each of the said links comprises a ball joint joining the bracket and the rod of the link, where the said ball joint can be set securely in position.

Furthermore, advantageously, each of the said links has a plurality of arrowheads on one of its faces, intended to be connected to a rear face of the antenna reflector.

In addition, advantageously, the modular interface system comprises at least one damper element.

The present invention also concerns an antenna reflector, in particular for an antenna of a space craft, in particular of a satellite. According to the invention, the antenna reflector comprises at least one, and preferably a plurality of, modular interface system(s), such as the one described above.

The present invention also concerns a space craft, in particular a satellite, which comprises at least one antenna reflector and at least one platform.

According to the invention, the said space craft comprises at least one modular interface system, such as the one described above, which produces the interface between the antenna reflector and the platform of the space engine, where the said links of the modular interface system are mechanically connected to the rear face of the antenna reflector, and where the said interface part of the modular interface system is mechanically connected to a mechanical element forming part of the platform.

In a preferred implementation, the said space craft comprises a set of modular interface systems mechanically connected to the rear face of the antenna reflector, where the said set of modular interface systems constitutes the sole interface between the antenna reflector and the platform. It does not therefore comprise any habitual rear structure.

In addition, in a first implementation the said mechanical element is a holding and release mechanism, whereas in a second implementation the said mechanical element is a deployment arm.

BRIEF DESCRIPTION OF THE FIGURES

The figures of the appended illustration will make it easy to understand how the invention can be produced. In these figures identical references refer to similar elements.

DETAILED DESCRIPTION OF PREFERRED EMBODIMENTS

Figure 1:
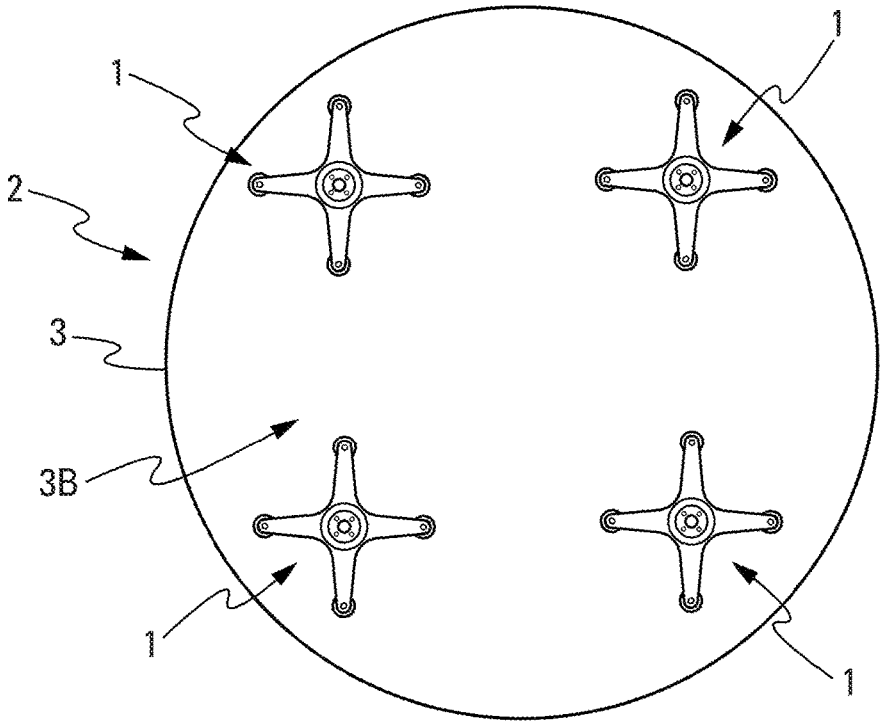
FIGS. 1 and 2 are diagrammatic views, respectively plane and perspective views, of a rear face of an antenna reflector, with modular interface systems according to a preferred implementation.
Figure 2:
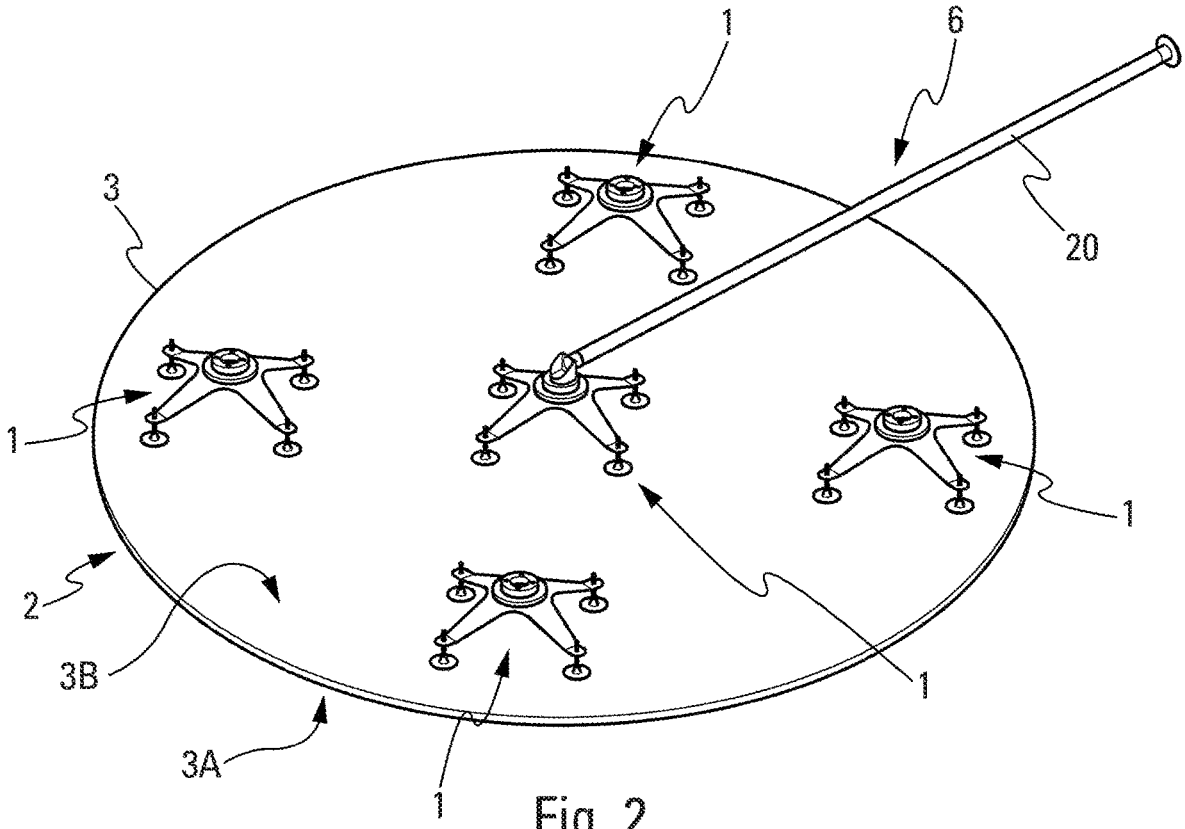

Modular interface system 1 (below, "system 1") is intended to be installed on an antenna reflector 2, as represented in FIGS. 1 and 2. This antenna reflector 2 forms part of an antenna of a space craft (not represented), in particular of a satellite.

This antenna reflector 2 comprises a rigid structure (or shell) 3 fitted with a reflecting or reflective surface (which is able to reflect electromagnetic waves). In the description below reference is made, for antenna reflector 2, to two faces 3A and 3B of shell 3, namely a face called front face 3A, which is the reflecting face, and a face called rear face 3B, which is the face opposite this front face 3A, and which is intended to receive one or more system(s) 1.

Although not exclusively, system 1 is intended more specifically to produce an interface between antenna reflector 2 of a satellite and a platform of the satellite. In the context of the present invention the term "platform" of a satellite or of a space craft is understood to mean a structural portion of the latter.

In the particular implementation represented in FIGS. 1 and 2, shell 3 has, respectively, four and five (modular interface) systems 1. It can of course comprise a different number of systems 1.

Figure 3:
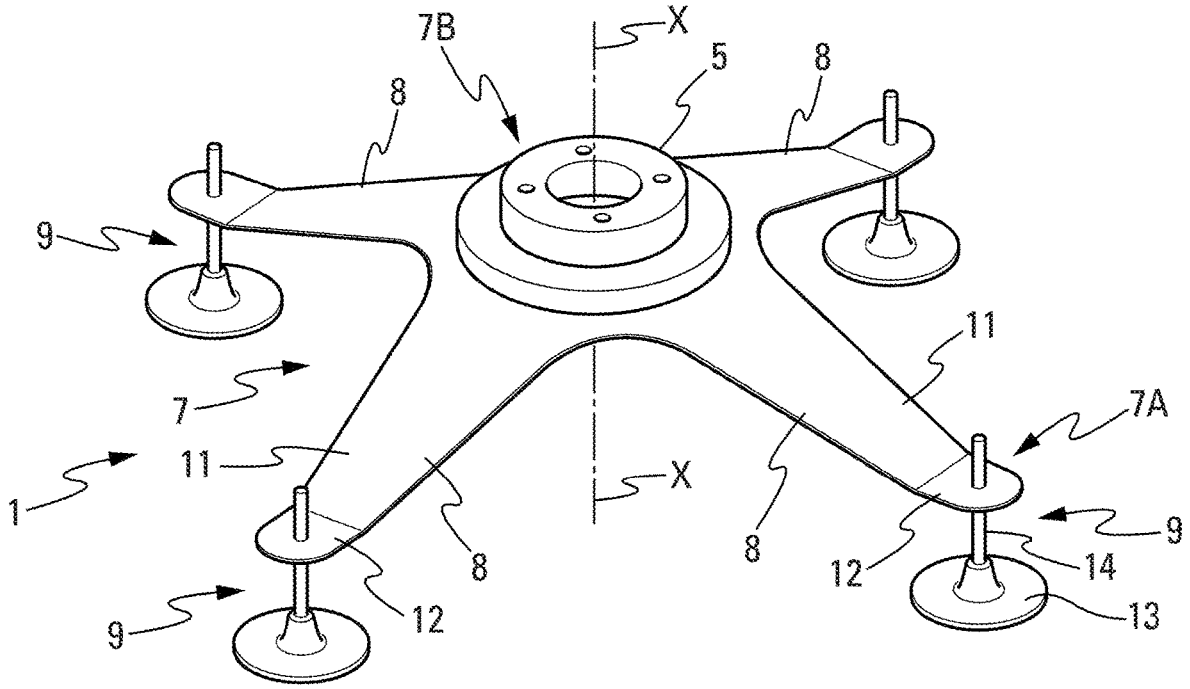
FIG. 3 is a perspective view of a modular interface system.
Figure 4:
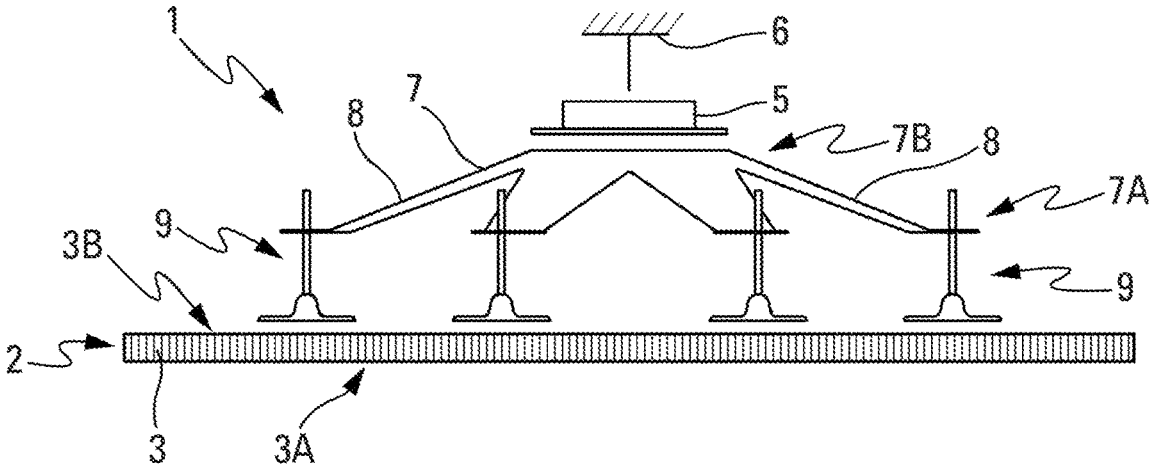
FIG. 4 is a diagrammatic side view of a modular interface system.

According to the invention, each (modular interface) system 1 comprises, as represented in FIGS. 3 and 4 in particular:

- an interface part 5 which is intended to be mechanically connected to a mechanical element 6 (FIGS. 2 and 4) forming part of the said platform of the space craft, in particular a satellite;
- a multi-legged structure 7 having, at a first end 7A, at least three feet 8, configured to make a mechanical connection between, firstly, interface part 5 installed at a second end 7B opposite said first end 7A, and secondly, respectively, a plurality of links 9. Each link 9 is attached to one of feet 8 of multi-legged structure 7 with which it is associated, where each foot 8 is thus connected to a link 9; and
- said links 9 which are intended to be attached to rear face 3B of shell 3 of antenna reflector 2, as stipulated below.

These various elements (interface part 5, multi-legged structure 7, links 9) are assembled together, as stipulated below, by means of mechanical hinges and joints, providing, during assembly, the clearances and degrees of freedom essential for the modularity of system 1.

In the implementation represented in particular in FIG. 3, system 1 is defined around an axis X-X, called the longitudinal axis, which can represent, in a particular implementation, an axis of rotational symmetry of system 1.

In addition, said mechanical element 6 (to which interface part 5 is connected) can be, for example:

- a deployment arm 20, as represented in FIG. 2. This deployment arm 20 can form part of a deployment device able to move antenna reflector 2 from a storage position to a deployed position; or
- a holding and release mechanism (not represented) to hold antenna reflector 2 in position relative to the platform, in particular in the storage position during launch.

Figure 5:
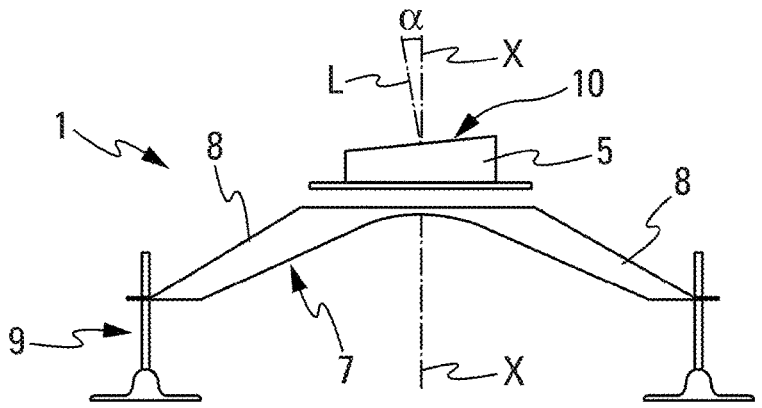
FIG. 5 shows, diagrammatically, an interface part of a modular interface system, fitted with a ball joint.

In a particular implementation, interface part 5 comprises a ball joint 10, as represented in FIG. 5. This ball joint 10 is intended to be connected mechanically to mechanical element 6 forming part of the said platform, and it can be set securely in position. This ball joint 10 enables axis L (along which mechanical element 6 (or a part connected to mechanical element 6), is connected to interface part 5) to have a (non-zero) angle $\alpha$ relative to longitudinal axis X-X.

To obtain an interface part 5 with a ball joint 10 the following can be used:

- a ball-and-socket bracket for the angular adaptation. This ball joint is set securely in position when antenna reflector 2 is assembled, either by stuffing with an adhesive, welding, screws and bolts, riveting or use of slugs. Ball joint 10 can be manufactured by a habitual machining process; or by manufacture of the Additive Layer Manufacturing (ALM) type, through the addition of material, i.e. by 3D printing.

Use of slugs can involve installation of slugs, such as metal lugs, which prevent the movement of one part relative to the other.

As represented in FIG. 3, in particular, multi-legged structure 7 comprises a plurality of feet 8. These feet 8 are distributed angularly around longitudinal axis X-X, are connected together to end 7B and spread out from longitudinal axis X-X towards end 7A.

Preferentially, a circular aperture (not visible) is made in end 7B of multi-legged structure 7 to receive interface part 5.

Each foot 8 comprises, as represented in FIG. 3, a structure 11, general elongated shape, having at end 7A a tab 12. Tab 12 is a curved portion relative to the plane of structure 11, such that the plane of plate 12 is roughly orthogonal to longitudinal axis X-X.

In the example represented in the figures, multi-legged structure 7 comprises four feet 8. Preferentially, for reasons of stability, structure 7 comprises at least three feet. However, a number of feet higher than three or four is also possible.

Figure 7:
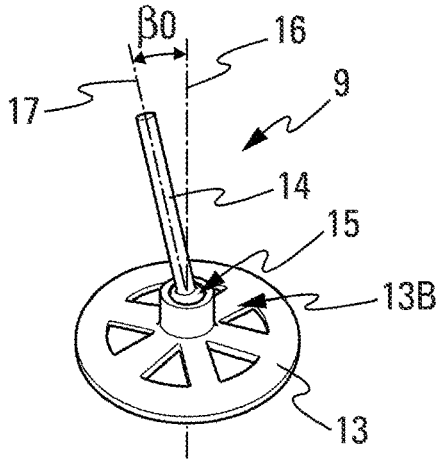
FIG. 7 is a perspective view of a link.

Furthermore, as represented in FIG. 7 in particular, each of links 9 comprises a roughly flat bracket 13, of generally circular shape, preferentially with apertures, in particular to reduce its mass. This bracket 13 is intended to be mechanically connected by a face 13A (FIG. 9) to rear face 3B of shell 3 of antenna reflector 2 as stipulated below, and a rod 14 installed, for example, roughly orthogonally to said bracket 13 (FIG. 9) in a face 13B of this bracket 13.

Figure 6:
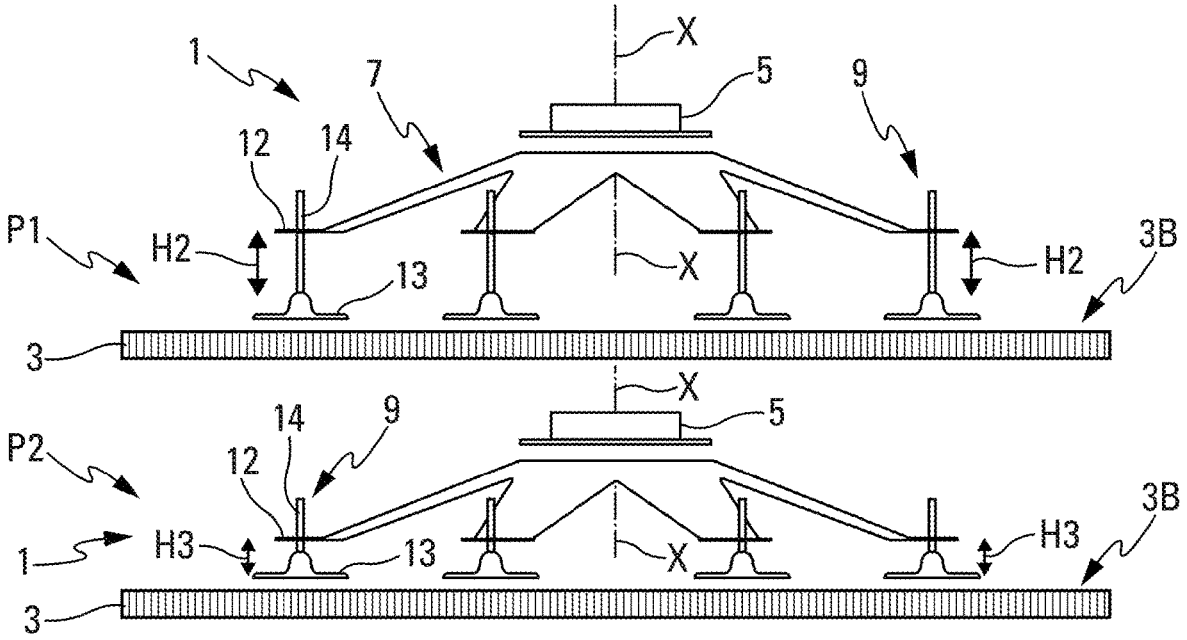
FIG. 6 comprises two superimposed diagrammatic views enabling a possibility for adjusting the height of the modular interface system to be shown.

System 1 can also comprise a screw connection between each of links 9 and foot 8 associated with multi-legged structure 7, and more specifically between rod 14 and tab 12. Using this screw connection, system 1 can be of variable height along axis X-X, i.e. roughly radially to rear face 3B, using a variable height between bracket 13 and associated plate 12, as illustrated for a height H2 (between bracket 13 and plate 12) in position P1 of the upper part of FIG. 6 and for a height H3 (between bracket 13 and plate 12) in position P2 of the lower part of FIG. 6.

The height of system 1 can thus be adjusted to several levels, considered individually or combined together, namely:

- by means of screwed/bolted junctions between multi-legged structure 7 and links 9;
- and also, by a specific definition of multi-legged structure 7.

Furthermore, in a particular implementation, each of links 9 comprises a ball joint 15 on an upper face 13B of bracket 13, joining bracket 13 and rod 14 of link 9 and enabling rod 14 to be aligned, as represented in FIG. 7. Using this ball joint 15, rod 14 can be set to a particular angular position relative to axis 16 which is roughly orthogonal to the basic plane of bracket 13, as illustrated by an angle β0 in FIG. 7. As soon as it is in the desired angular position, ball joint 15 can be set securely in position. Shell 3 of antenna reflector 2 can, in particular, be of a specific shape for the requirements of the mission in question, as represented for example in FIG. 8. In certain cases the shape is such that the alignment of system 1 with shell 3 is greatly impacted, as is its bearing surface.

Figure 8:
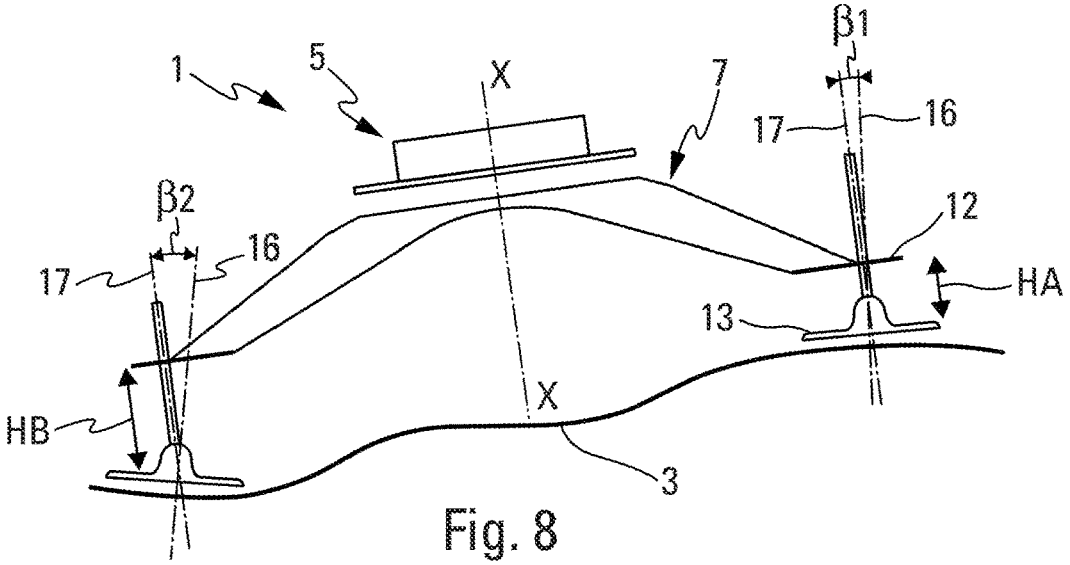
FIG. 8 shows a possibility for installing the modular interface system in a particular manner, designed for the surface of an antenna reflector.

The angular alignment capacity of links 9 (using ball joints 15) enables them to adapt to the shape of the surface (and in particular to the local perpendicular), as represented by angles β1 and β2 in FIG. 8.

In a particular implementation, ball joint 15 of link 9 is manufactured by a manufacturing process of the ALM type. One alternative consists in integrating a habitual ball joint 15 in link 9 using a screwed or bonded assembly.

Ball joint 15 is set securely in position when antenna reflector 2 is assembled, either by stuffing with an adhesive, welding, screws and bolts, riveting or use of slugs.

There can also be different heights between tab 12 and bracket 13, for different links 9, as illustrated by different heights HA and HB in FIG. 8.

To adapt to a part of the angle multi-legged structure 7 can also be modified to include a height difference between links 9.

Links 9 can be attached in different habitual manners to shell 3 of antenna reflector 2.

Figure 9:
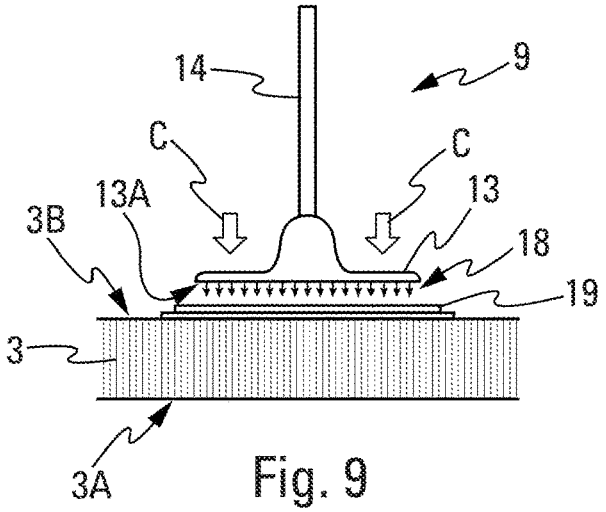
FIG. 9 shows diagrammatically an example attachment of a link in a wall of an antenna reflector.

However, in a particular implementation, each of links 9 has a plurality of arrowheads (for example of the Hyper Joint type) 18 on one of the faces of bracket 13, namely face 13A (opposite face 13B), intended to be connected to rear face 3B of shell 3 of the antenna reflector, as represented in FIG. 9.

These arrowheads 18 are inserted into the material of shell 3 via a skin strengthener 19, as illustrated by arrows C in FIG. 9. These arrowheads 18 which are securely coupled to bracket 13 thus enable a stable attachment to shell 3 with suitable characteristics.

Shell 3 can be a thin sandwich shell of the CFRP type (carbon fibre reinforced polymer composites), a thick sandwich shell of the CFRP type, a membrane of the CFRP type, or alternatively a monolithic shell of the CFRP type.

In addition, system 1 comprises at least one damper element (not represented). This damper element (whether a joint, spring, metal blade, etc.) enables the stiffness of the assembly to be reduced (and thus enables the transmission of the forces between system 1 and shell 3 means to be controlled and optimised), and enables use to be made of damping in the event of dynamic stresses (vibrations during the launch phase, in particular).

The mechanical and thermal performance of antenna reflector 2 is thus guaranteed. In particular:

- the mass of antenna reflector 2 is reduced due to the absence of a rear structure, as stipulated below;
- the mechanical performance (stiffnesses, transmissions of forces, etc.) is provided by:
  - the attachment of the joints and hinges either by stuffing of adhesive, welding, screwing, riveting or use of slugs;
  - the fitting of at least one damper element;
  - the diffusion of the forces by means of multi-legged structure 7 and the number of links 9. Optimisation by the number of links 9 is possible, by changing, for example, from a tripod to a device with four or more feet;
- the thermal stability performance can be optimised through the use of specific low-CTE (coefficient of thermal expansion) materials such as, for example:
  - a metal alloy of the INVAR type;
  - CFRP (carbon fibre reinforced polymer) composites.
- Furthermore, concerning industrialisation, all systems 1 have the advantages of parts standardisation and reduction of manufacturing operations.

Parts standardisation is permitted through the insertion of clearances and degrees of freedom in system 1, which allows adaptation to the interface means used, and provides compatibility with a wide range of surfaces. Standardisation also allows simplification of industrialisation (generic ranges and documentation).

The reduction of the number of manufacturing operations is also obtained, in particular:

- through the elimination of the rear structure, as indicated below;
- by attachment using arrowheads 18 (FIG. 9).

In a preferred implementation, antenna reflector 2 or the space craft in question (in particular a satellite), which includes this antenna reflector 2, comprises a set of such (modular interface) systems 1, all of which are mechanically connected to rear face 3B of shell 3 of antenna reflector 2, as represented in FIGS. 1 and 2. This set of systems 1 constitutes the sole interface between antenna reflector 2 and the platform of the space craft, or in other words that no use is made of a habitual rear structure.

Systems 1 are independent of one another. The independence of each system 1 allows it to be positioned in any manner, as desired, on rear face 3B of shell 3 of antenna reflector 2. System 1 is thus adaptable to a large variety of interface configurations.

This set of systems 1 has many advantages, and in particular the following main advantages concerning antenna reflector 2:

- an overall reduction of the cost of antenna reflector 2;
- reduction of the delivery cycle time of antenna reflector 2 through a minimisation of the justification effort and of the duration and number of manufacturing operations (bonding, drape forming, assembly, etc.);
- simplification of antenna reflector 2 through the reduction of the number of parts and standardisation; and
- reduction of the mass of antenna reflector 2, whilst guaranteeing the attainment of the required performance.

All systems 1 also have the following advantages:

they provide modularity of the assemblies satisfying the various interface requirements with the platform of the space craft (number of interface points, positions, stiffnesses, etc.);

they ensure multi-surface compatibility by adapting to a wide range of diameters, with multiple parabola geometries, and also substantial shaping of the surface;

they guarantee mechanical, thermal and functional performance, in particular with a low weight budget, resistance to the thermomechanical environment, and low impact on the stability and precision of the surface profile; and they allow simplified industrialisation and use.

The invention claimed is:

1. A modular interface system configured for producing an interface between a space antenna reflector and a platform of the a space craft, wherein said modular interface system comprises:

an interface part (5) which is configured to be mechanically connected to a mechanical element (6) forming part of the said platform;

a multi-legged structure (7) having, at a first end (7A), at least three feet (8), making mechanical connection between, firstly, the interface part (5) installed at a second end (7B) opposite the said first end (7A) and, secondly, respectively, a plurality of links (9), where each link (9) is connected to one of the feet (8) of the multi-legged structure (7) with which it is associated; and the said links (9), which are configured to be mechanically connected to a rear face (3B) of the space antenna reflector (2).

2. The modular interface system according to claim 1, wherein said modular interface system comprises a screwed connection between each of the said links (9) and the associated foot (8) of the multi-legged structure (7).

3. The modular interface system according to claim 1, wherein said modular interface system comprises a screwed connection between the interface part (5) and the multi-legged structure (7).

4. The modular interface system according to claim 1, wherein the interface part (5) comprises a ball joint (10) configured to be mechanically connected to the said mechanical element (6) forming part of the platform and able to be set securely in position.

5. The modular interface system according to claim 1, wherein each of the said links (9) comprises a roughly flat bracket (13), intended to be mechanically connected to a rear face (3B) of the antenna reflector (2), and a rod (14) installed in a traverse direction to the said bracket (13).

6. The modular interface system according to claim 5, wherein each of the said links (9) comprises a ball joint (15) making the junction between the bracket (13) and the rod (14) of the link (9), where the said ball joint (15) can be set securely in position.

7. The modular interface system according to claim 1, wherein each of the said links (9) has a plurality of arrowheads (18) on one (13A) of its faces, intended to be connected to a rear face (3B) of the antenna reflector (2).

8. The modular interface system according to claims 1, wherein said modular interface system comprises at least one damper element.

9. A space antenna reflector, comprising a rear face (3B), and at least one modular interface system (1) comprising:

an interface part (5) configured to be mechanically connected to a mechanical element (6) forming part of a space craft platform;

a multi-legged structure (7) having, at a first end (7A), at least three feet (8) making a mechanical connection between, firstly, the interface part (5) installed at a second end (7B) opposite the said first end (7A) and, secondly, respectively, a plurality of links (9), where each link (9) is connected to one of the feet (8) of the multi-legged structure (7) with which it is associated; and where the said links (9) which are mechanically connected to the rear face (3B) of the space antenna reflector (3).

10. The space antenna reflector according to claim 9, wherein said at least one modular interface system (1) comprises a plurality of such modular interface systems (1), wherein the said links (9) of each modular interface system (1) are mechanically connected to the rear face (3B) of the space antenna reflector (3).

11. A space craft, in particular a satellite, comprising at least one antenna reflector and at least one platform, wherein said space craft further comprises at least one modular interface system (1) comprising:

an interface part (5) mechanically connected to a mechanical element (6) forming part of the said platform;

a multi-legged structure (7) having, at a first end (7A), at least three feet (8) making a mechanical connection between, firstly, the interface part (5) installed at a second end (7B) opposite the said first end (7A) and, secondly, respectively, a plurality of links (9), where each link (9) is connected to one of the feet (8) of the multi-legged structure (7) with which it is associated; and the said links (9), which are mechanically connected to a rear face (3B) of the antenna reflector (2);

whereby the modular interface system (1) produces an interface between the antenna reflector (2) and the platform of the space engine.

12. The space craft according to claim 11, wherein the said mechanical element (6) is a holding and release mechanism.

13. The pace craft according to claim 11, wherein the said mechanical element (6) is a deployment arm (20).

14. The space craft according to claim 11, wherein said at least one modular interface system (1) comprises a set of such modular interface systems (1), wherein the said links (9) of each modular interface system (1) are mechanically connected to the rear face (3B) of the antenna reflector (2), where the said set of modular interface systems (1) constitutes the sole interface between the antenna reflector (2) and the platform.

* * * * *